US006879796B2

(12) United States Patent
Monahan et al.

(10) Patent No.: US 6,879,796 B2
(45) Date of Patent: Apr. 12, 2005

(54) DUAL DRIVE TORQUE SPLIT TECHNIQUE

(75) Inventors: Michael B. Monahan, Webster, NY (US); David A. Hughes, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/602,801

(22) Filed: Jun. 24, 2003

(65) Prior Publication Data

US 2004/0265004 A1 Dec. 30, 2004

(51) Int. Cl.[7] ..... G03G 15/00
(52) U.S. Cl. ..... 399/167; 399/162
(58) Field of Search ..... 399/9, 36, 116, 399/159, 162, 167, 301; 347/116

(56) References Cited

U.S. PATENT DOCUMENTS 4,330,194 A * 5/1982 Murakami ..... 399/167
4,711,562 A * 12/1987 Pothast et al. ..... 399/162
5,381,167 A * 1/1995 Fujii et al. ..... 347/116
5,418,600 A * 5/1995 Genovese ..... 399/167
6,421,513 B1 * 7/2002 Casella et al. ..... 399/162

* cited by examiner

*Primary Examiner*—Sandra L. Brase
(74) *Attorney, Agent, or Firm*—Perman & Green, LLP

(57) ABSTRACT

A constant torque split is maintained between a pair of drive motors for the photoreceptor belt of an electrophotographic printing machine. By varying the voltage applied to the motors according to the speed of the photoreceptor belt, the torque applied by each motor can be continuously balanced at a predetermined relationship to apply a constant torque and the desired speed may be accurately maintained. To better refine the implementation, the relationship include a ratio and an offset which may be applied, to one of the motors. Furthermore, this offset is ramped up during motor acceleration to optimize motion quality and system performance.

16 Claims, 4 Drawing Sheets

DUAL DRIVE TORQUE SPLIT TECHNIQUE

BACKGROUND OF THE INVENTION

1. Field of the Invention

This invention relates to a dual motor system for driving a photoreceptor belt with a balanced torque to improve image registration in an electrophographic electrophotographic imaging system.

2. Brief Description of Related Developments

Electrophotographic printing machines employ photoreceptor members, typically in the form of a belt that is electrostatically charged to a potential so as to sensitize the surface thereof. The charged portion of the belt is exposed to a light image of an original document being reproduced. Exposure of the charged member selectively dissipates the charge thereon in the irradiated areas to record an electrostatic latent image corresponding to the informational areas contained within an original document. After the electrostatic latent image is recorded on the photoreceptor member, a developer material is brought into contact therewith to develop the latent image. The electrostatic latent image may be developed using a dry developer material comprising carrier granules having toner particles adhering triboelectrically thereto or using a liquid developer material. Toner particles are attracted to the latent image, forming a visible powder image on the surface of the photoreceptor belt. After the electrostatic latent image is developed with the toner particles, the toner powder image is transferred to a substrate, such as a sheet of paper. Thereafter, the toner image is heated to permanently fuse the image to the substrate.

In order to reproduce a color image, the printing machine includes a plurality of imaging stations each of which deposits a toner of a given color. Each station has a charging device for charging the photoreceptor surface, an exposing device for selectively illuminating the charged portions of the photoreceptor surface to record an electrostatic latent image thereon, and a developer unit for developing the electrostatic latent image with toner particles. Each developer unit deposits different color toner particles on the electrostatic latent image. The images are developed, at least partially, in superimposed registration with one another to form a multi-color toner powder image. The resultant multi-color powder image is subsequently transferred to a substrate. The transferred multi-color image is then permanently fused to the sheet forming the color print. To obtain a high quality color image, registration of the images at each of the developer stations is essential.

Registration is achieved by accurately positioning the photoreceptor belt at the various imaging and developing stations along the belt path using a drive mechanism that typically comprises drive rollers that advance a substrate along the path and backer bars that support the belt. Many such drive rollers have a coating commercially known as an EPDM elastomer that is applied to the surface thereof to improve friction coupling between the drive mechanism and the belt. Due to backer bar and subsystem drag, the drive rollers often experience slippage at the photoreceptor belt and at other locations along the belt when the surface of the drive roller encounters particle contamination. Slippage has a deleterious impact on image registration, particularly when latent images are applied at multiple imaging stations.

An auxiliary belt drive may address slippage problems, but in order to be effective, the torque level and proper location of the auxiliary drive is essential to attain optimum drive benefit while at the same time satisfying motion quality and registration requirements of the imaging system. In addition, belt tensioning and drive capacity requirements must also be met.

One solution to the slippage problem is presented in U.S. Pat. No. 6,421,523 which issued to the same assignee as this application. This patent describes a belt drive module that achieves the above goal by providing a torque assist drive that applies a torque assist force to the belt at a location between the drive roller and the tension roller. In this instance the torque assist force is provided by a constant torque friction clutch or a current limited DC motor. This system operates in a torque limiting manner.

Image registration may be more difficult in designs where low friction between the drive roll and the belt occurs due to a large wrap angle. In these situations dual drive rolls are needed to apply the required torque to the photoreceptor belt. It a purpose of this invention to provide a dual roll drive mechanism for a photoreceptor belt. It is also a purpose of this invention to distribute the torque between the drive rolls in a predetermined manner to maintain a constant torque on the belt.

SUMMARY OF THE INVENTION

The drive system of this invention consists of a pair of brushless motors, a first motor provides a main drive torque and a second motor provides a supplemental drive torque. The second drive motor distributes the applied torque according to a predetermined function of the main drive. A constant torque split is maintained between the drive motors by holding the ratio of the torque applied by each motor constant. By varying the voltage applied to the motors according to the speed of the photoreceptor belt, the torque applied by each motor can be continuously balanced at a predetermined ratio to apply a constant cumulative torque and the desired speed may be accurately maintained. In order to further optimize motion quality and performance of the system, an additional predetermined amount of voltage is applied to the assist motor referred to as offset. The offset magnitude is ramped as the motor accelerates and reaches its full magnitude when the system achieves its desired steady state speed. Ramping the offset value allows the system to avoid oscillations and instability that could otherwise occur at start up.

BRIEF DESCRIPTION OF THE DRAWINGS

The drive system of this invention is explained in more detail below with reference to the accompanying drawing, in which.

DESCRIPTION OF THE PREFERRED EMBODIMENT

Figure 1:
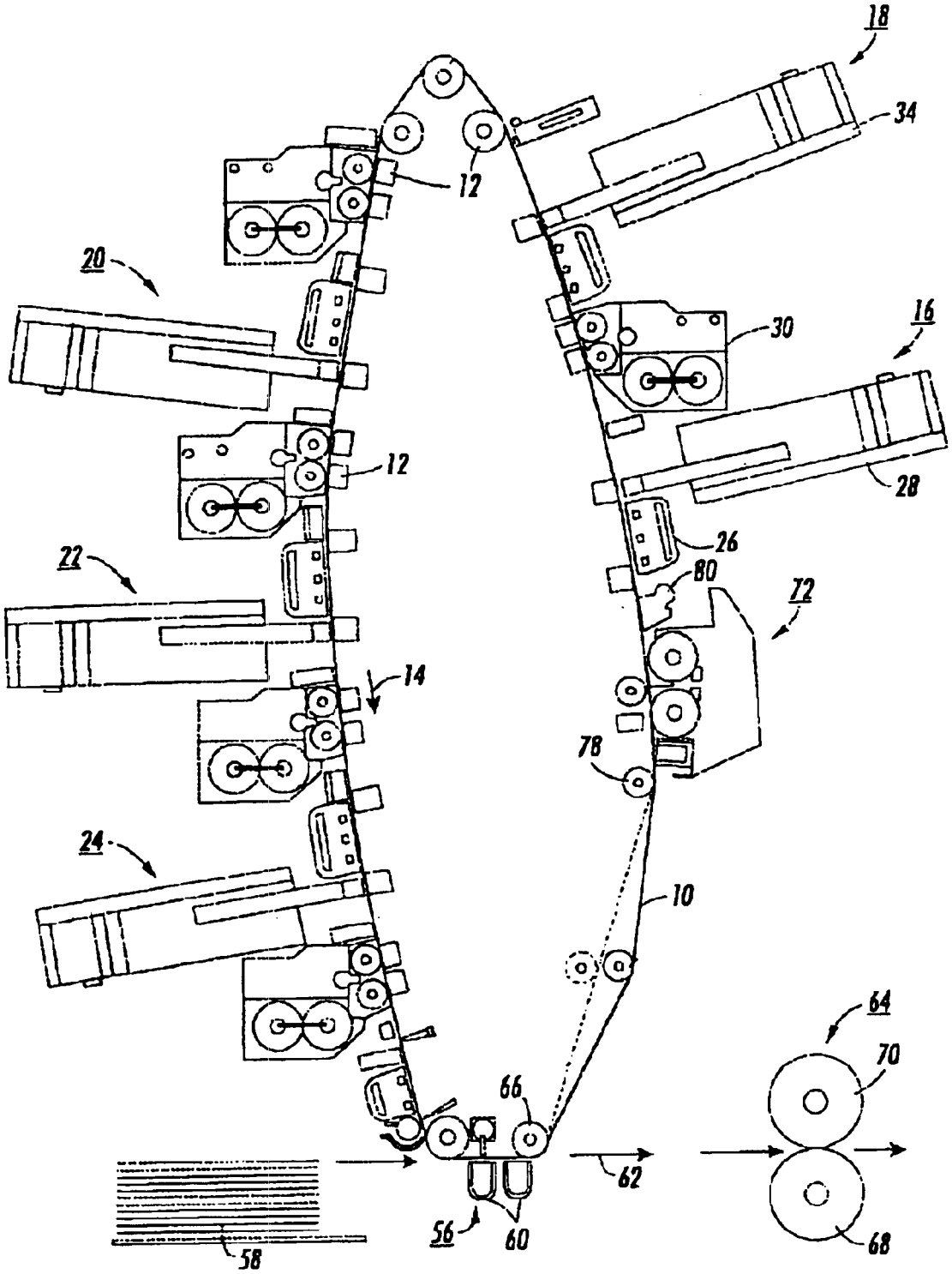
FIG. 1 shows a belt drive module of an electrophotographic imaging system to illustrate an environment in which the present invention may be deployed.

As an illustration of the context of the system of this invention, a single pass multi-color printing machine is shown in FIG. 1. This printing machine employs a photoreceptor belt 10, supported by a plurality of rollers or backer bars 12. Belt 10 advances in the direction of arrow 14 to move successive portions of the external surface of photoreceptor belt 10 sequentially along a path including various image processing stations.

The illustrative printing machine includes five image recording stations indicated generally by the reference numerals 16, 18, 20, 22, and 24, respectively. Initially, belt 10 passes through image recording station 16. Image recording station 16 includes a charging device and an exposure device. The charging device includes a corona generator 26 that charges the exterior surface of belt 10 to a relatively high, substantially uniform potential. After charging of the exterior surface of photoreceptor belt 10, the charged portion thereof advances to an exposure device. The exposure device includes a raster output scanner (ROS) 28, which illuminates the charged portion of the exterior surface of photoreceptor belt 10 to record a first electrostatic latent image thereon.

Developer unit 30 develops this first electrostatic latent image. Developer unit 30 deposits toner particles of a selected color on the first electrostatic latent image. After the highlight toner image has been developed on the exterior surface of belt 10, belt 10 continues to advance in the direction of arrow 14 to a second image recording station 18 where the imaging process is repeated at recording stations 18, 20, 22, and 24, as described in incorporated U.S. Pat. No. 5,946,533, assigned to the same assignee hereof. Recording stations 18, 20, 22, 24 include components similar to recording station 16, but are arranged to deposit a different color toner.

At each recording station, a latent image is recorded in registration with the previous latent image. Photoreceptor belt 10 ultimately advances the multi-color toner powder image to a transfer station, indicated generally by the reference numeral 56. At transfer station 56, a receiving medium, i.e., paper, is advanced from stack 58 by a sheet feeder and guided to transfer station 56. At transfer station 56, a corona generating device 60 sprays ions onto the backside of the paper. This attracts the developed multicolor toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoreceptor belt 10. A vacuum transport moves the sheet of paper in the direction of arrow 62 to fusing station 64.

Fusing station 64 includes a heated fuser roller 70 and a backup roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multicolor image thereon. After fusing, the finished sheet is discharged to a finishing station where the sheets are compiled and formed into sets, which may be bound to one another. These sets are then advanced to a catch tray for subsequent removal therefrom by the printing machine operator.

Invariably, after the multi-color toner powder image has been transferred to the sheet of paper, residual toner particles remain adhering to the exterior surface of photoreceptor belt 10. The photoreceptor belt 10 moves over isolation roller 78, which isolates the cleaning operation at cleaning station 72. At cleaning station 72, the residual toner particles are removed from belt 10. The belt 10 then moves under spots blade 80 to also remove toner particles therefrom.

Figure 2:
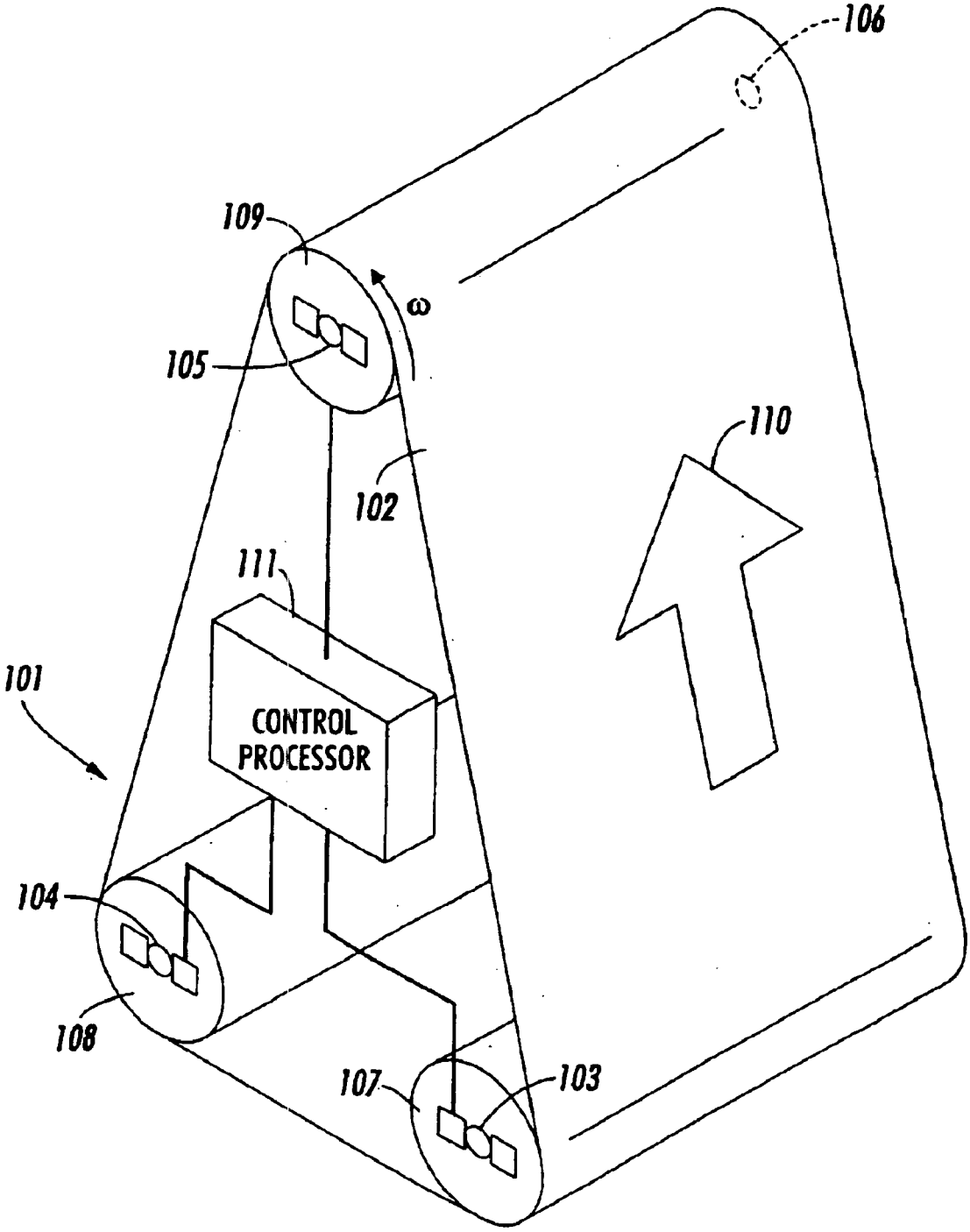
FIG. 2 is a schematic illustration of the drives system of this invention.

A drive system 101 for a photoreceptor belt 102, according to this invention, is shown schematically in FIG. 2 and is constructed having a main drive motor 103, an assist drive motor 104, and a steering motor 105. The drive motors 103 and 104, are operatively connected to rollers 107 and 108 respectively to rotate the rollers. Photoreceptor belt 102 is wrapped around the rollers 107–109 under tension for rotation, driven by the motors 103 and 104 in the direction of arrow 110. An encoder 106 is positioned in contact with the belt 102 to generate a signal indicative of the actual belt speed $\omega$. The steering motor 105 is a stepping motor which is connected independently to adjust the tilt angle of roller 109 in response to control processor 111. The tilt angle of roller 109 causes a force to be applied to the belt that has a component transverse to the primary direction 110 of belt movement. Steering motor 105 is controlled to prevent sideways walking of the belt and to maintain alignment of belt 102 on the rollers 107–109. Edge position sensors (not shown) may be used to provide a feedback signal to the control processor 111 for the required tilt compensation.

Drive motors 103 and 104 can be brushless motors selected to provide the required torque to the rollers 107 and 108 respectively at available voltage levels. Control processor 111 adjusts the input voltage 114 (see FIG. 4*a*) to main drive motor 103 in response to actual speed signals from encoder 106. The belt 102 is driven by the combined torque of motors 103 and 104, the applied torque is split between motors 103 and 104 at a predetermined function. The voltage 114 is therefore adjusted to obtain and maintain a torque contribution from motors 103 and 104 which will result in a predetermined operating speed for photoreceptor belt 102.

Assist motor 104 is driven by a voltage 115, which is provided at a percentage of voltage 114 by amplifier 112. In this manner the applied torque is split between rollers 103 and 104 according to a predetermined function.

Figure 3:
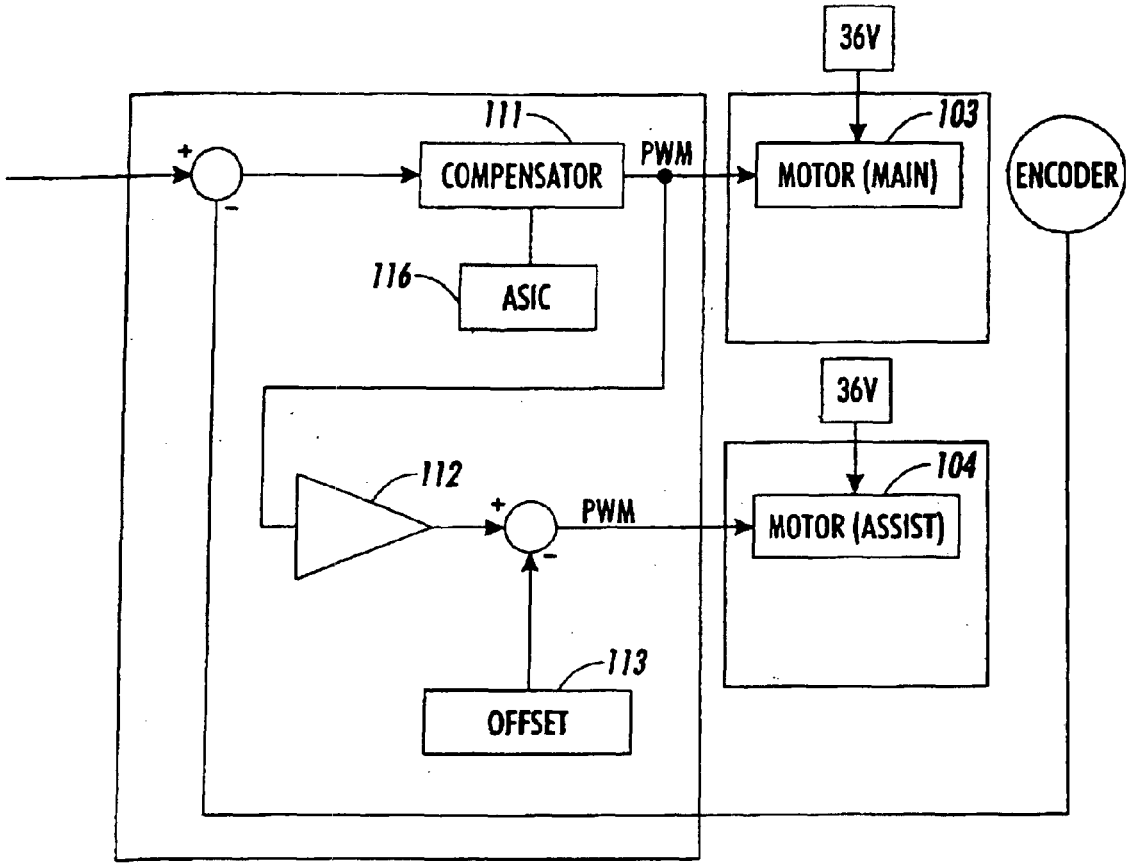
FIG. 3 is a block diagram of a control circuit for applying power to the drive motors of this invention.

The control system for the motors 103 and 104 is shown schematically in the block diagram of FIG. 3. Control processor (Compensator circuit) 111 generates a pulse width modulated signal to drive the main drive motor 103 and the assist drive motor 104. The dual drive system 101 of this invention is particularly advantageous where the wrap angle of the belt 102 is large, thereby limiting the frictional engagement with the rollers 107–109. Compensator circuit 111 includes firmware 116, such as an ASIC, having an imbedded algorithm that calculates the required voltage that will provide the desired torque according to the characteristic torque profile of the motors used.

The motors 103 and 104 respond with a combined output torque in accordance with the duty cycle of the pulse width modulator signal 114, which is adjusted, depending on the desired speed of the belt 102. A feed back signal from encoder 106, allows the actual belt speed to be monitored and the duty cycle of the drive signal 114 is adjusted if needed. As stated above, the main drive motor 103 receives the adjusted signal.

Assist motor 104 is driven by voltage 115 which is a function of the voltage applied to the main drive motor 103. This function consists of a ratio or percentage of the main drive motor voltage plus an offset 113. The ratio remains fixed to maintain a constant torque to the belt rollers 107 and 108. The offset 113 is ramped in the same manor that the motor is ramped during acceleration. As shown in FIG. 4*b*, the offset 113 reaches its full magnitude when the belt encoder 106 indicates the operational belt speed. This optimizes motion quality and belt performance as the main drive motor 103 starts and reaches its destination operating speed. The assist drive signal to motor 104 therefore is governed by the relation $V_{15}=V_{14}*K+b$, where K is the assist ratio and b is the offset value.

Figure 4A:
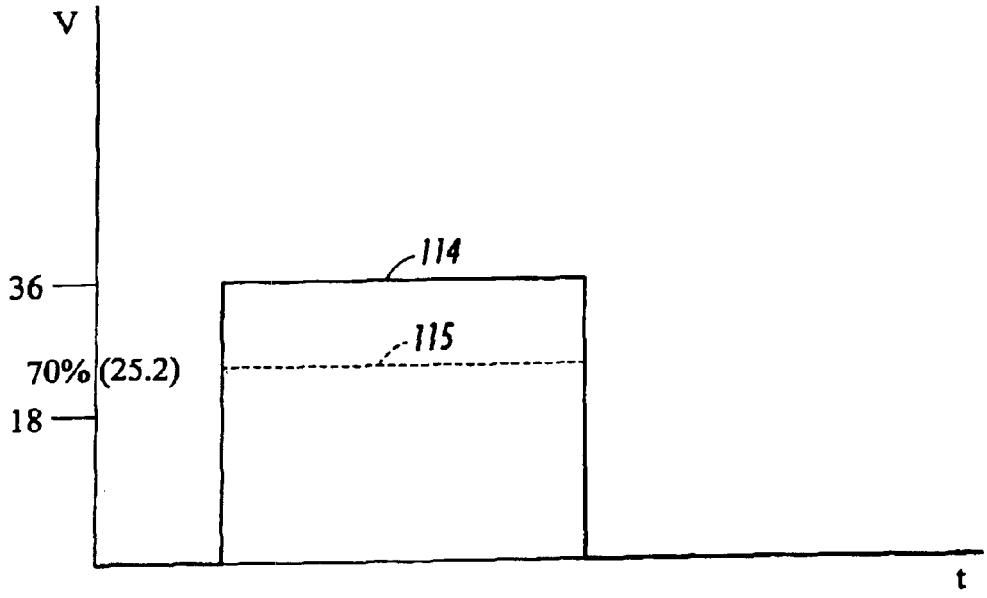
FIG. 4*a* is a graph of the input voltages to the drive motors of this invention.
Figure 4B:
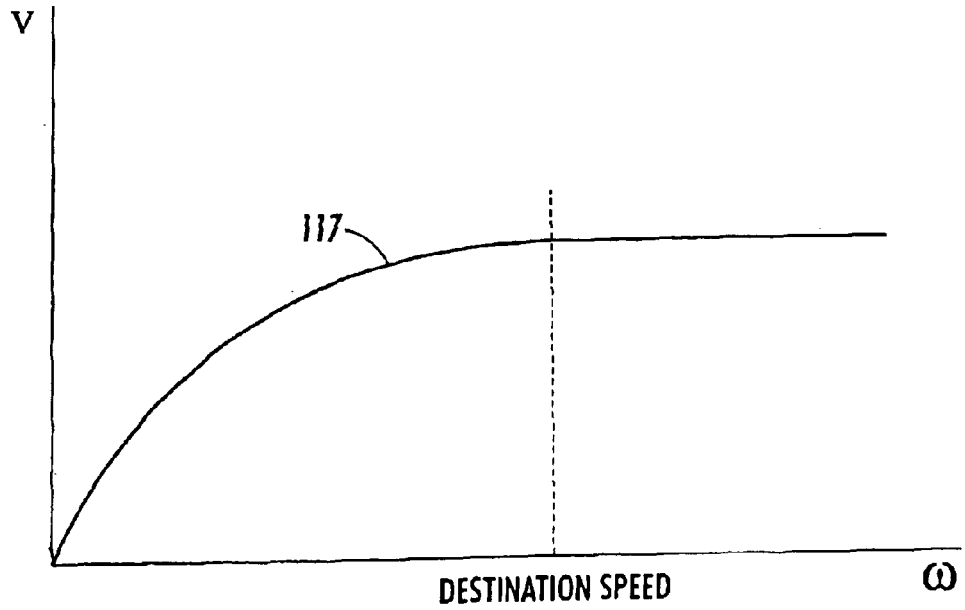
FIG. 4*b* is a graph of the offset increment supplied to the assist drive motor of this invention.

As shown in the graph of FIG. 4*a*, an available supply voltage of, for example 36 volts, may be varied by adjusting the pulse width modulated drive signal 114 for different duty cycles, i.e. 100%=36 volts, 50%=18 volts, etc. As shown in FIG. 3, the assist motor drive signal is obtained from the output of the compensator 111 and adjusted by a fixed percentage, for example 70%, by amplifier 112. The offset voltage 117 varies with belt speed according to a predetermined acceleration profile, for example as shown in FIG. 4*b*, as an addition to the drive voltage input for assist motor 104.

Applied voltage 114 can be determined by the torque characteristics of the motors 103 and 104. The overall applied torque is determined by the speed required for belt 102. The applied torque is the combined torque ($T_3+T_4=T_{applied}$) contributed by motors 103 and 104. In general the voltage needed to generate the applied torque can be calculated for a given speed of belt 102 by the relation: Torque=$Kt*(V_{INPUT}-(Kv*\omega)$. Through this relationship a linear relation can be derived between the voltage input to drive motor 103, for a given torque $T_{applied}$, and the voltage input to the assist motor 104. The imbedded algorithm of control processor 111 takes into consideration the difference between actual speed and desired speed according to a compensator routine to obtain voltage for motor 103. The assist motor voltage 115 is calculated by applying the ratio plus the variable offset. In some circumstances, it may be desirable to apply a negative offset, for example, a mirror image of ramp 117 of FIG. 4*b*.

While the present invention is described in connection with preferred embodiments thereof, it will be understood that it is not intended to limit the invention to those embodiments. On the contrary, it is intended to cover all alternatives, modifications and equivalents as may be included within the spirit and scope of the invention as defined by the appended claims.

What is claimed is:

1. A system for driving a photoreceptor belt, for an electrophotographic printing machine, at a predetermined operating speed comprising:

a speed sensor operatively associated with said photoreceptor belt to sense the speed of the belt and generate a signal indicative thereof;

a main drive motor and an assist drive motor operatively associated with said photoreceptor belt to apply a cumulative torque thereto, said cumulative torque being split between said main drive motor and said assist drive motor according to a predetermined function;

a first control circuit for supplying an input voltage to said main drive motor to enable said main drive motor to generate a torque according to said predetermined function, said first control circuit including a circuit for receiving said speed signal from said speed sensor and comparing said indicated speed with a predetermined operating speed and further adjusting said input voltage relative to the difference; and a second control circuit for supplying an input voltage to said assist drive motor to enable said assist drive motor to generate a torque according to said predetermined function.

2. A system for driving a photoreceptor belt, for an electrophotographic printing machine, at a predetermined operating speed, as described in claim 1, wherein said predetermined function comprises a ratio of said input voltage to said main drive motor to said input voltage to said assist drive motor.

3. A system for driving a photoreceptor belt, for an electrophotographic printing machine, at a predetermined operating speed, as described in claim 1, wherein, to provide said predetermined function, said second control circuit supplies a voltage to said assist drive motor as a percentage of the input to said main drive motor.

4. A system for driving a photoreceptor belt, for an electrophotographic printing machine, at a predetermined operating speed, as described in claim 1, wherein to provide said predetermined function, said second control circuit supplies a voltage to said assist drive motor as a percentage of the input to said main drive motor plus a predetermined increment to said assist drive motor input voltage.

5. A system for driving a photoreceptor belt, for an electrophotographic printing machine, at a predetermined operating speed, as described in claim 4, wherein said predetermined increment is varied according to the speed of the photoreceptor belt.

6. A system for driving a photoreceptor belt, for an electrophotographic printing machine, at a predetermined operating speed, as described in claim 5, wherein said predetermined function increases said increment as the belt accelerates from 0 to 100% of said predetermined increment when the photoreceptor belt reaches its operating speed.

7. A system for driving a photoreceptor belt, for an electrophotographic printing machine, at a predetermined operating speed, as described in claim 1, wherein the input of said second control processor is connected to the output of said first control processor.

8. A system for driving a photoreceptor belt, for an electrophotographic printing machine, at a predetermined operating speed, as described in claim 1, wherein the output of the first control processor is a pulse wave modulated signal.

9. A method for driving a photoreceptor belt, for an electrophotographic printing machine, at a predetermined operating speed comprising the steps of:

sensing the speed of said photoreceptor belt and generating a signal indicative thereof;

driving said photoreceptor belt at said operating speed by engaging a main drive motor and an assist drive motor with said photoreceptor belt to apply a cumulative torque thereto, said cumulative torque being split between said main drive motor and said assist drive motor according to a predetermined function;

supplying an input voltage to said main drive motor to enable said main drive motor to generate a torque according to said predetermined function, adjusting said input voltage in response to a difference between said speed signal from said speed sensor and a predetermined operating speed; and supplying an input voltage to said assist drive motor to enable said assist drive motor to generate a torque according to said predetermined function.

10. A method for driving a photoreceptor belt, for an electrophotographic printing machine, at a predetermined operating speed, according to claim 9, wherein, to provide said predetermined function, said second control circuit supplies an input to said assist motor at a percentage of said input to said main drive motor.

11. A method for driving a photoreceptor belt, for an electrophotographic printing machine, at a predetermined operating speed, according to claim 9, wherein, to provide said predetermined function, said second control circuit supplies a voltage to said assist drive motor as a percentage of the input to said main drive motor plus a predetermined increment to said assist drive motor input voltage.

12. A method for driving a photoreceptor belt, for an electrophotographic printing machine, at a predetermined operating speed, according to claim 11, wherein said predetermined increment is varied according to the speed of the photoreceptor belt.

13. A method for driving a photoreceptor belt, for an electrophotographic printing machine, at a predetermined operating speed, according to claim 11, wherein in said step of adding said predetermined increment, said increment reaches full magnitude when the photoreceptor belt reaches its operating speed.

14. A method for driving a photoreceptor belt, for an electrophotographic printing machine, at a predetermined operating speed, according to claim 11, wherein said step of supplying the input to said second control processor is accomplished by connecting said second control processor to the output of said first control processor.

15. A method for driving a photoreceptor belt, for an electrophotographic printing machine, at a predetermined operating speed, according to claim 9, wherein in said step of supplying a voltage to said assist drive motor, said voltage is supplied as a percentage of the input to said main drive motor.

16. A method for driving a photoreceptor belt, for an electrophotographic printing machine, at a predetermined operating speed, according to claim 9, wherein the voltage is supplied to said main drive motor as a pulse wave modulated signal.

* * * * *